United States Patent [19]

Feitzelmayer

[11] Patent Number: 4,976,796

[45] Date of Patent: Dec. 11, 1990

[54] METHOD FOR ELECTRICALLY AND MECHANICALLY CONNECTING THE ENDS OF TWO JACKETED ELECTRICAL CONDUCTORS TO EACH OTHER

[75] Inventor: Ernst Feitzelmayer, Munich, Fed. Rep. of Germany

[73] Assignee: MTU Motoren-Und Turbinen Union Muenchen GmbH, Munich, Fed. Rep. of Germany

[21] Appl. No.: 268,576

[22] Filed: Nov. 8, 1988

[30] Foreign Application Priority Data

Nov. 12, 1987 [DE] Fed. Rep. of Germany ..... 3738440

[51] Int. Cl.[5] ..... B21F 15/02

[52] U.S. Cl. ..... 156/49; 29/868; 29/872; 174/84 C; 174/93; 174/94 R

[58] Field of Search ..... 156/49; 29/868, 872; 174/75 R, 84 R, 87, 93, 84 C, 94 R

[56] References Cited

U.S. PATENT DOCUMENTS

| | | | |
|---|---|---|---|
| 1,308,389 | 7/1919 | Beaver et al. | 174/93 X |
| 2,156,772 | 5/1939 | Seeley | 156/49 X |
| 2,621,228 | 12/1952 | Tompers | 174/93 |
| 3,243,501 | 3/1966 | Patrick et al. | 174/87 |
| 3,553,827 | 1/1968 | Baker et al. | 29/872 X |
| 3,739,470 | 6/1973 | Eppler | 174/87 X |
| 4,266,992 | 5/1981 | Agaisse | 174/84 C X |
| 4,292,099 | 9/1981 | Dinger | 174/84 R X |
| 4,588,241 | 5/1986 | Ardezzone | 439/851 X |
| 4,679,723 | 7/1987 | Veit et al. | 29/828 X |

*Primary Examiner*—David Simmons
*Assistant Examiner*—James J. Engel
*Attorney, Agent, or Firm*—W. G. Fasse; D. H. Kane, Jr.

[57] ABSTRACT

An electrical conductor or cable splice is formed by passing the conductor ends from which any insulation has been removed through a ceramic insert so that portions of the conductor ends protrude out of the ceramic insert. These protruding portions are then mechanically and electrically connected to each other, by example, by soldering, welding, or brazing. A metal sleeve is then pushed over the ceramic insert and the ends of the sleeve are hermetically sealed to the metal jackets of the conductors or cable. The seal is accomplished, for example, for soldering. In this manner a so-called parallel connection is easily made in which the conductors double back. A longitudinal connection can also be made in which the conductors continue in the same direction through two inner sleeves and through an outer sleeve.

14 Claims, 2 Drawing Sheets

METHOD FOR ELECTRICALLY AND MECHANICALLY CONNECTING THE ENDS OF TWO JACKETED ELECTRICAL CONDUCTORS TO EACH OTHER

FIELD OF THE INVENTION

The invention relates to a method for producing an electrical and mechanical connection between the ends of two electrical conductors which are electrically insulated and mechanically protected by a metal jacket. The metal jacket protects these so-called thermo-conductors against high temperature influences.

BACKGROUND INFORMATION

Electrical conductors encased in a metal jacket are used in many different environments, for example, in the gas turbine power plant manufacture. Such conductors are used for transmitting electrical signals obtained by electrically transforming measured values of pressures and temperatures. These values must be continuously measured on power plant structural components such as compressors, combustion chambers, and/or turbines or the like. The measured signals are needed for testing and designing purposes as well as for closed and open loop control purposes. Values measured for control purposes include relevant operational variables and parameters.

Repair and maintenance work in which structural power plant components are partially dismantled require frequently a separation of the above mentioned jacketed conductors. On the other hand, upon reassembly of the components the same conductors hence must again be electrically and mechanically connected for providing the required uninterrupted conductors. Such reconnection is also known as splicing. Such splicing may also become necessary when sections of the conductor become useless due to an unintended entry of moisture. In that case, the damaged conductor sections including their metal jackets are removed and a new length of conductor with its metal jacket is spliced into the circuit.

Conventional splicing frequently requires a substantial length of time for its performance and a constructional investment for performing the splicing. This is true, especially when several separate electric conductors of different polarities must be connected exactly and in a durable manner, whereby the electrical and mechanical connection must be fail-safe and without any electrical grounding or rather unintended short-circuiting.

In one splicing concept a sleeve made of Teflon (RTM) is applied to the encased conductor ends by shrinking the sleeve onto these ends. This type of splicing is not suitable because it is not sufficiently temperature resistant. Such splices are required to withstand temperatures exceeding about 260° C. for prolonged periods of time and temperatures of about 350° C. for short durations.

Another concept splices two jacketed conductors by means of an insulating high temperature cement used to form a base to which the conductor ends are cemented. This procedure requires an enormous amount of time because each of several different cement layers requires at least one hour of curing time at a temperature of about 180° C. Another disadvantage of this approach is seen in that the curing temperature, or rather the curing heat, must be provided by an external heat source with the added disadvantage that the applied heat is quickly dissipated through the metal jackets. The dissipated heat in turn could heat neighboring structural components of the power plant in an unpermissible manner.

OBJECTS OF THE INVENTION

In view of the foregoing it is the aim of the invention to achieve the following objects singly or in combination:

- to provide a method for the splicing of jacketed electrical conductors in a relatively simple, yet fail-safe manner;
- to provide such a splicing method which can be performed with due regard to external operating conditions such as high temperatures and high relative humidities which must not adversely affect the resulting splice;
- to avoid any connection of the conductors to the metal jacket so as to prevent undesired electrical short-circuits;
- to enable an electrical connection between the conductor ends by welding, brazing, or soldering;
- to assure a hermetic seal once the splicing is completed;
- to provide a splice of the type described which can be located in any desired position, for example, of a turbine power plant without regard to the temperatures prevailing in the particular location; and
- to facilitate the assembly and disassembly as well as reassembly of structural power plant components by easily made splices that can be located as desired without forming large conductor loops while nevertheless avoiding any kinks in the conductors.

SUMMARY OF THE INVENTION

According to the invention the above objects have been achieved by the following splicing method according to the invention. First, conductor ends protruding from the metal jackets are passed through axial bores in a ceramic insert which holds the conductor ends in place without permitting any contact between the conductor ends and the metal jackets, A portion of each conductor end protrudes out of the ceramic insert so that conductor end portions having the same polarity are electrically connected to each other, for example, by welding, brazing, or soldering. Then, a metallic outer sleeve is placed around the electrical connection, around the ceramic insert, and around the metal jackets of the conductors. This metallic outer sleeve is then hermetically sealed by soldering it to the metal jackets. Inner sleeves and an outer sleeve may be combined.

The present method can be applied when two conductor ends protrude out of the ceramic insert at the same end of the insert or when the conductors protrude out of the insert at opposite ends thereof. When the conductor ends protrude from the same insert end, the resulting connection is called a parallel or double back connection herein. When the conductor ends protrude out of opposite insert ends, the connection will be called a longitudinal connection.

The present method has the following advantages. The ceramic insert fixes the conductor ends in parallel to each other and in a defined position relative to each other. The bores in which the conductor ends are received in the ceramic insert extend longitudinally through the insert. Substantially the same type of insert may be used for forming a so-called parallel connection or for forming a so-called longitudinal connection. In both instances the electrical connection of the conductor ends to the metal jacket is positively prevented, thereby avoiding a short-circuit to ground.

The trouble-free guiding of the conductor ends in the ceramic insert assures achieving an excellent electrical connection between the wire ends, either by welding or soldering or brazing since the wire ends are always maintained in parallel to each other.

The ceramic insert requires very little space and its use is uncomplicated. If necessary, the electrical connection or splice can be reduced in size for miniaturization.

By using suitable solders for securing the outer sleeve to the metal jackets of the conductors, the resulting splices are capable of withstanding temperatures up to 900° C. By using a nickel solder it is even possible to achieve splices capable of withstanding temperatures exceeding 900° C.

The resulting splice is hermetically sealed and hence it is not sensitive to the relative humidity, to oil, and any other aggressive medium cannot impair the effectiveness of the splice.

All the components of the splice can be cut from yard goods, in other words, the outer sleeve may be cut from a respective tubular member and the ceramic insert may also be produced in this fashion. Complicated auxiliary means or tools are not necessary. Hence, the present splicing method can be performed out in the field.

The connections of the conductor ends can be visually inspected and electrically tested prior to the final soldering of the outer sleeve. Similarly, the mechanical location of the conductor ends can also be tested prior to the final soldering of the outer sleeve.

The present splice can be located anywhere along the length of a conductor. Accordingly, the splice can be placed in any desired location of a power plant, including locally hot locations. Structurally locating the splices in cooler zones is not necessary.

The present splices are also very advantageously usable in connection with difficult assembly operations where the conductors cannot be pulled directly out of an assembly. In such a situation the structural components or groups of such components such as modules of a gas turbine power plant can be equipped with the respective conductor sections and these sections are then spliced just prior to the mechanical connection of the structural components or modules. Thus, the present splices permit locating the conductors in positions not possible heretofore.

Similarly, where a partial disassembly of a power plant or the like is necessary, the conductors such as measuring conductors can be severed at the mechanical separation points. After reassembly the severed electrical conductors can be spliced as disclosed herein. As a result, a removal and reassembly of the conductor sections is not necessary.

Yet another important advantage of the invention is seen in that the present splices may be located in any direction without regard to the orientation or axial orientation of the structural components or the assembled power plant. This advantage is achieved because the parallel connection that is possible according to the invention can be formed substantially without formation of any loops, thereby avoiding kinking the jacketed conductors or the splices.

BRIEF DESCRIPTION OF THE DRAWINGS

In order that the invention may be clearly understood, it will now be described, by way of example, with reference to the accompanying drawings, wherein.

Figure 1:
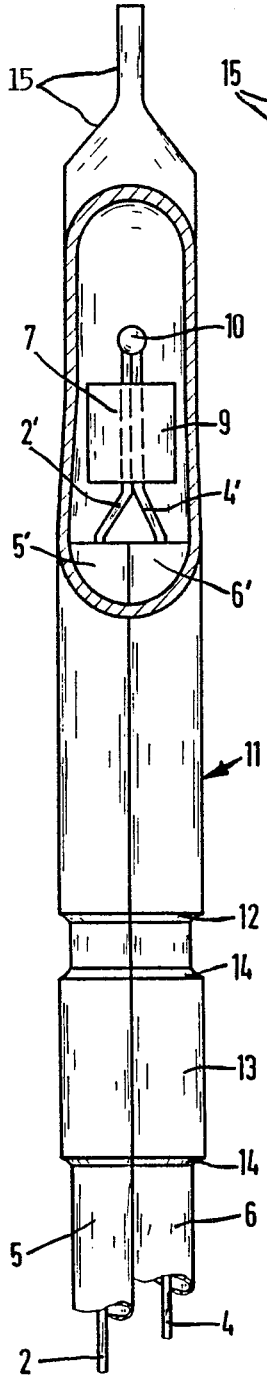
FIG. 1 illustrates a parallel connection or splice according to the invention between four jacketed high temperature conductors, whereby the outer sleeve is partially cut away to show the internal structure of the double back splice.

DETAILED DESCRIPTION OF PREFERRED EXAMPLE EMBODIMENTS AND OF THE BEST MODE OF THE INVENTION

The method according to the invention produces an electrical and a mechanical connection between coordinated ends of metal jacketed electrical conductors capable of operating under high temperature conditions. The electrical conductors 1, 2, 3, and 4 are electrically insulated as is conventional. Additionally, the insulated conductors are surrounded by metal jackets 5 and 6. For example, it is necessary to connect the ends of the conductors 2 and 4 with each other and also the ends of the conductors 1 and 3 with each other. According to the invention a ceramic insert 9 having longitudinal bores 7 and 8 therethrough, is used for mechanically locating the wire ends prior to their interconnection. The wire ends from which the electrical insulation has been removed are passed through these longitudinal bores 7 and 8 of the ceramic insert 9, whereby any short-circuit between the wire ends and the metal jackets 5, 6 is prevented. The bores 7, 8 hold the respective wires in parallel and so that they overlap each other, whereby portions of the wire ends protruding from end of the insert 9 are electrically and mechanically interconnected, for example, by welding spots 10. Instead of welding, soldering or brazing may be employed. Once the connection 10 is established, an outer cover sleeve or bushing 11 of suitable metal is slipped onto the jacket ends 5 and 6. The free end 15 of the sleeve 11 is squeezed tight and soldered closed. This may be accomplished even before slipping the cover sleeve 11 onto the jackets 5 and 6. A solder or brazing seam 12 then secures the lower end of the cover sleeve 11 to the jackets 5 and 6 to form a hermetic seal.

Suitable pliers may be used to bend the bared wire ends into a proper shape to fit these ends through the bores 7 and 8 in the ceramic insert 9. Any excessively protruding length of wire may be cut with the same set of pliers prior to forming the connecting spots 10. The required bends are shown at 2' and 4' in FIG. 1 and at 1(3) as well as 2(4) in FIG. 2. In any event, the bending will be such that the respective wire ends properly fit into the bores 7 and/or 8.

The just described parallel connection of the wire ends is just as easily formed as the longitudinal connection to be described below.

Figure 2:
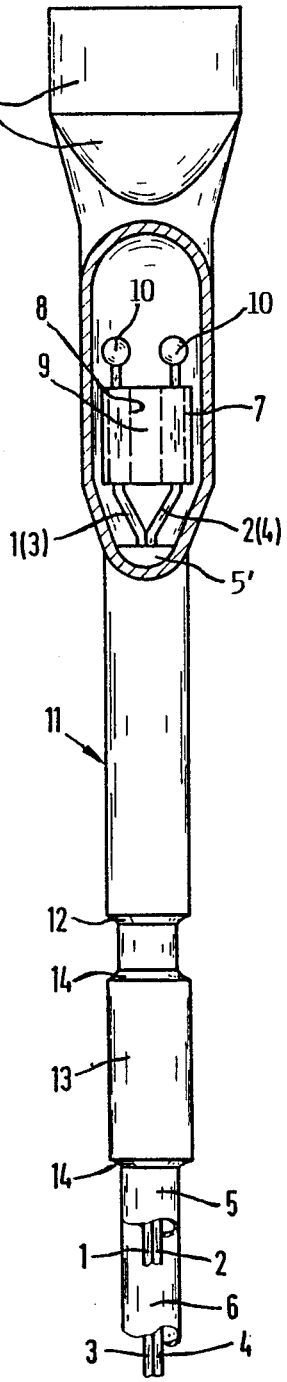
FIG. 2 is a view as in FIG. 1, but turned by 90° and again with the outer sleeve partially cut away.

Especially for forming a parallel connection, it may be preferable to first fix the two ends 5' and 6' of the metal jackets 5 and 6 relative to each other by slipping a positioning sleeve 13 over the jacket ends 5', 6'. The positioning sleeve 13 is tight enough to hold the jacket ends 5' and 6' in a fixed position relative to each other so that the ends align with each other as seen in FIG. 1. The positioning sleeve 13 is clamped in place and then soldered to the jackets 5 and 6 at the solder seams 14. Preferably, the solder seams 12 and 14 are formed simultaneously. Rather than forming the squeezed-tight end 15 first, it may also be formed last. In any event, suitable molding pliers are available for the squeezing of the end 15.

Figure 3:
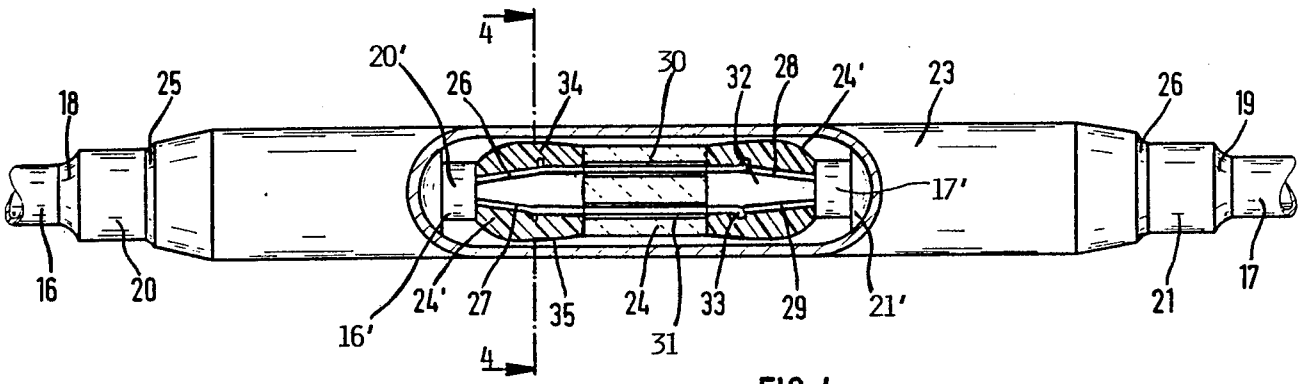
FIG. 3 is a side view of a longitudinal splice according to the invention, again with the outer sleeve partially cut away to make the internal splice structure visible.

FIG. 3 illustrates the above mentioned longitudinal connection forming a splice between four conductors 26, 27 encased by the jacket 16 and conductors 28, 29 encased by the jacket 17. First, a reinforcing inner sleeve 20, 21 is soldered with its respective free end to the corresponding jacket. Thus, a solder or brazing seam 18 connects the inner sleeve 20 to the jacket 16. A solder or brazing seam 19 connects the inner sleeve 21 to the jacket 17. Then the wire ends are passed through bores in a ceramic insert 24. The wire ends may then be slightly bent over as shown at 32, 33, 34, and 35, whereupon the connection is made by soldering, brazing or welding. Bending the ends as shown at 32, 33, 34, and 35 facilitates the soldering, but is not absolutely necessary.

After the completion of the above mentioned electrical connection a common outer or cover sleeve 23—at first having been positioned on one of the jackets 16 or 17 respectively—is then slipped over said inner sleeves 20, 21 in such a position in that it surrounds the electrical connection for sealing purposes. After the establishment of the above mentioned sealing position an absolutely hermetical sealing of the electrical connection is provided in that the free ends of the common cover sleeve 23 and the inner sleeves 20, 21 are to be soldered or brazed together as being indicated by soldering or brazing seams 25, 26.

If desired, an insulating material 24' is used to embed or encapsulate the conductor portions 26, 27, between the jacket end 16' and the insert 24. Similarly, the conductor ends 28 and 29 are also embedded in such an insulating material 24' between the end 17' of the jacket and the end of the insert 24. An epoxy resin or the like is suitable for the embedding.

Figure 4:
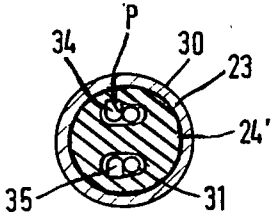
FIG. 4 is a sectional view along section line 4—4 in FIG. 3.

The bores 30 and 31 in the insert 24 are large enough to pass the desired number of wires through the insert. As best seen in FIG. 4 each bore 30, 31 has an oval shape to accommodate two wires passing in parallel through the respective bore. More than two bores may be provided in an insert. These bores will extend substantially in parallel.

It is possible to make the soldering or brazing seams 18, 19, 25, and 26 all at once after the internal assembly has been completed as described above.

It is recommended that the sleeves used according to the invention should be made of metals that are similar or the same as the metals of which the jackets are made so that all components made of metal have substantially the same heat expansion coefficients. Making the jackets and sleeves of nickel or nickel alloys has been found to be very advantageous and satisfactory for the present purposes.

Where the splice is to be used in high temperature working conditions it is advantageous to make at least the outer sleeve and in the embodiment of FIGS. 3 and 4 also the inner sleeves of platinum or an alloy containing a high proportion of platinum. Even platinum or platinum alloy coatings on sleeves made of other metals such as nickel or similar metals have been found to be effective under high temperature working conditions.

The splice assembly of FIGS. 3 and 4 may be made, for example, by the following sequence of steps:

- removing the insulating from the ends of the wires 26, 27, 28, and 29;
- slipping the inner sleeves 20, 21 onto the respective jacket 16, 17;
- bending the conductor ends into the proper conductor identity or shape;
- making the proper conductor identity or polarity onto the relevant conductor end;
- slipping the wire ends 26, 27 through the bores 30, 31 in the insert 24;
- slipping the wire ends 28, 29 through the respective bore, thereby paying attention for the proper polarity so that the plus wire is connected to the plus wire and the minus wire is connected to the minus wire, for example;
- properly orienting the conductor ends and, if desired, bending over the end portions 32, 33, 34, and 35;
- forming the spot welds P and cutting off any excess wire length;
- embedding the so formed connection with the insulating material 24' is desired;
- shifting the inner sleeves into the position shown in FIG. 3;
- shifting an outer sleeve 23 into the position shown in FIG. 3; and
- forming the solder seams 18, 19, 25, and 26.

Care should be taken that the embedding material 24' reaches all the way to the free ends 16', 17' of the jackets 16, 17. These ends 16', 17' could also be partially embedded, if desired.

In the embodiment of FIGS. 3 and 4 the outer sleeve 23 has to be slipped over the inner sleeves 20, 21 after the welding spots P have been formed providing a closed casing and the position of the electrical connection and passing along the respective cable length at the splice location.

Although the invention has been described with reference to specific example embodiments, it will be appreciated, that it is intended to cover all modifications and equivalents within the scope of the appended claims.

What I claim is:

1. A method for splicing to each other insulation free ends of insulated electrical conductors each protruding from a jacket end or a respective metal jacket enclosing said insulated electrical conductors and for protecting the splice against high temperatures up to at least 900° C., comprising the following sequences of steps:

(a) providing at least one through bore in a ceramic insert, said through bore having a cross-section sufficient for holding at least two of said insulation free conductor ends in said one through bore, (b) aligning with said through bore at least two insulation free conductor ends having the same polarity, (c) threading said two insulation free conductor ends having the same polarity through said at least one through bore of said ceramic insert so that said two insulation free conductor ends protrude out of the same through bore with an overlap, (d) local welding or brazing said insulation free conductor ends at said overlap to each other, so that conductor ends of the same polarity are electrically and mechanically connected to each other in a high temperature resistant manner, (e) sliding a metal cover sleeve onto said ceramic insert so that said metal cover sleeve surrounds both of said metal jacket ends of said electrical conductors and said ceramic insert, thereby also covering said ceramic insert and said locally connected overlap, whereby said ceramic insert supports and spaces said insulation free conductor ends in and from said metal cover sleeve, and (f) brazing said metal cover sleeve directly or indirectly to both of said metal jacket ends to form a hermetic seal between said cover sleeve and both of said metal jacket ends.

2. The method of claim 1, comprising providing said ceramic insert with a plurality of through bores extending in parallel to each other, and threading at least two insulation free conductor ends having the same identity, through each bore of said plurality of bores.

3. The method of claim 1, further comprising placing, prior to step (c), two of said metal jackets in parallel to each other so that said jacket ends are aligned with each other, and then sliding a positioning sleeve (13) onto said aligned free jacket ends for securing said free jacket ends in a fixed position relative to each other for forming a double back splice, wherein said conductors are mechanically connected to each other in a side-by-side configuration.

4. The method of claim 1, further comprising sliding, prior to step (a), an inner sleeve (20, 21) into a position on each of said jacket ends, and then, after steps (a) to (e) have been performed, performing said brazing step for hermetically sealing each of said inner sleeves to the respective metal jacket and to said cover sleeve for forming an overall sealed longitudinal splice in which said conductors are mechanically connected substantially in an end-to-end configuration.

5. The method of claim 4, wherein said hermetically sealing step includes brazing said inner sleeves to said metal jackets and said cover sleeve to said inner sleeves separately or simultaneously.

6. The method of claim 1, further comprising squeezing closed a free end of said cover sleeve and then hermetically sealing the squeezed closed sleeve end to form a side-by-side conductor configuration.

7. The method of claim 4, wherein said inner sleeves are so positioned on said jacket ends that said jacket ends slightly protrude axially from the respective inner sleeve.

8. The method of claim 2, wherein first conductors are passed through said bores in said ceramic insert in one direction and then second conductors with corresponding polarities are passed through the same bores in the opposite direction, so that free conductor ends protrude from both insert ends in an overlapping relationship with the respective other conductor, and then performing said connecting of overlapping conductor ends at each insert end.

9. The method of claim 8, wherein one of a pair of said free conductor ends is first bent over (at 32, 33, 34, 35) prior to said local welding.

10. The method of claim 1, further comprising embedding connected wires next to said ceramic insert in an electrically insulating mass.

11. The method of claim 1, comprising making all sleeves and said metal jackets of the same or similar metals so that all metal components have substantially the same heat expansion coefficient.

12. The method of claim 11, comprising making all sleeves and all jackets of nickel or a nickel alloy.

13. The method of claim 11, comprising making all sleeves and all jackets of platinum or a platinum alloy.

14. The method of claim 11, comprising cladding all sleeves and all metal jackets with platinum or a platinum alloy.

* * * * *

UNITED STATES PATENT AND TRADEMARK OFFICE

CERTIFICATE OF CORRECTION

PATENT NO. : 4,976,796

DATED : December 11, 1990

INVENTOR(S) : Erst Feitzelmayer

It is certified that error appears in the above-identified patent and that said Letters Patent is hereby corrected as shown below:

ON THE TITLE PAGE

In Abstract [57], line 11, replace "for soldering" by --by soldering--;

Claim 1, line 3 (column 6, line 50) replace "jacket end or a" by --jacket end of a--;

Claim 1, line 6, (column 6, line 53) replace "sequences" by --sequence--.

Signed and Sealed this

Twenty-first Day of April, 1992

*Attest:*

HARRY F. MANBECK, JR.

*Attesting Officer*

*Commissioner of Patents and Trademarks*